US007469789B2

(12) United States Patent
Ehrat et al.

(10) Patent No.: US 7,469,789 B2
(45) Date of Patent: Dec. 30, 2008

(54) METHOD AND DEVICE FOR SEPARATING LETTERS

(75) Inventors: Josef Ehrat, Munich (DE); Werner Halder, Waldburg (DE); Karl-Josef Kurtz, Brunnthal (DE); Heinz Pechtl, Kuemmersbruck (DE); Norbert Weber, Puchheim (DE)

(73) Assignee: Deutsche Post AG, Bonn (DE)

( * ) Notice: Subject to any disclaimer, the term of this patent is extended or adjusted under 35 U.S.C. 154(b) by 48 days.

(21) Appl. No.: 10/564,304

(22) PCT Filed: Jun. 7, 2004

(86) PCT No.: PCT/DE2004/001163

§ 371 (c)(1),
(2), (4) Date: Nov. 30, 2006

(87) PCT Pub. No.: WO2005/007306

PCT Pub. Date: Jan. 27, 2005

(65) Prior Publication Data

US 2007/0164506 A1 Jul. 19, 2007

(30) Foreign Application Priority Data

Jul. 10, 2003 (DE) ..... 103 31 410

(51) Int. Cl.
*B07C 9/00* (2006.01)

(52) U.S. Cl. ..... 209/658; 209/672; 209/900; 271/245

(58) Field of Classification Search ..... 271/149, 271/150, 151, 245, 237, 58.1, 52.12; 209/552, 209/596, 663, 668, 671, 672, 900, 658, 657, 209/654, 665

See application file for complete search history.

(56) References Cited

U.S. PATENT DOCUMENTS

| | | | | |
|---|---|---|---|---|
| 2,905,309 A | 2/1959 | Makrides | ..... | 198/31 |
| 2,961,085 A | 11/1960 | Stovall | ..... | 198/30 |
| 3,126,201 A | 3/1964 | Rehm | ..... | 271/32 |
| 4,851,075 A * | 7/1989 | Parker | ..... | 156/556 |

(Continued)

FOREIGN PATENT DOCUMENTS

| | | |
|---|---|---|
| CH | 273 832 | 2/1951 |

(Continued)

OTHER PUBLICATIONS

International Search Report in PCT/DE2004/001163 dated Sep. 24, 2004.

*Primary Examiner*—Kaitlin S Joerger
(74) *Attorney, Agent, or Firm*—Marshall, Gerstein & Borun LLP

(57) ABSTRACT

Method and device for separating letters by transporting a pile of non-separated and unordered letters by a conveyor band in a continuous flow of essentially non-superposed letters which are largely distributed on said conveyor band. At least one retention plate which is fixed to an axis of rotation in a radial direction with respect thereto rotates around the axis of rotation, which is transversally arranged with respect to the transporting direction of the conveyor band, horizontally and above said conveyor band in such a way that the retention plate arranged under the axis of rotation has a velocity component oriented in the opposite direction to the direction of travel of the conveyor band.

7 Claims, 3 Drawing Sheets

U.S. PATENT DOCUMENTS

| | | | | |
|---|---|---|---|---|
| 5,477,957 | A | 12/1995 | Bold | 198/622 |
| 5,507,380 | A | 4/1996 | Hamma | 198/455 |

FOREIGN PATENT DOCUMENTS

| | | | |
|---|---|---|---|
| CH | 273832 | | 2/1951 |
| DE | 512 940 | | 11/1930 |
| DE | 1 198 283 | | 8/1965 |
| DE | 25 52 157 | | 5/1977 |
| DE | 41 28 636 | A1 | 3/1993 |
| FR | 1 442 267 | | 6/1966 |
| FR | 1.442.267 | | 6/1966 |

* cited by examiner

METHOD AND DEVICE FOR SEPARATING LETTERS

BACKGROUND OF THE INVENTION

1. Field of the Invention

The invention relates to a method for separating letters in which irregularly spaced and disordered piles of letters that are being transported on a conveyor belt are rendered into a continuous stream of letters that are largely not lying on top of each other and that are distributed virtually homogeneously over the conveyor belt. Moreover, the invention relates to a device that is suitable for carrying out the method.

2. Related Technology

An automated separation and sorting line usually includes a conveyor belt onto which boxes or sacks that are delivered at irregular intervals are emptied, as a result of which irregularly spaced and disordered piles of letters are formed on the conveyor belt.

The letters arranged on the conveyor belt in such a way are then normally fed to one or more successive separators with the objective of rendering the above-mentioned arrangement of the letters made up of disordered piles into an arrangement that is made up of letters that are largely not lying on top of each other and that are situated virtually homogeneously on the conveyor belt, thus corresponding to a continuous stream of letters that are largely not lying on top of each other and that are distributed virtually homogeneously on the conveyor belt.

An arrangement of a separator for separating letters is described in U.S. Pat. No. 2,905,309, especially in FIG. 1 thereof. In the disclosed arrangement, the letters initially reach a first conveyor belt via an inclined plane, whereby the conveyor belt conveys the letters to a second conveyor belt via a swing tray that exerts an influence on the regulation of the conveyor belt. This second conveyor belt feeds the letters to another separator that includes a rotating drum with protruding thin strips or "fingers " that pull or push the letters individually off the conveyor belt and into a shaft. The drum is installed above the conveyor belt crosswise to the conveying direction in such a way that the strips can touch the conveyor belt and the drum in the described device rotates in such a way that the strips move in the conveying direction whenever they are below the axis of rotation.

The described arrangement and especially the transport via the swing tray that influences the regulation of the conveyor belt is carried out with the same objective as that of the method according to the invention, but is very complex. Moreover, in case of a high mail volume, it can happen that letters lying on the tray are pushed off by the subsequent letters so that the conveyor belt can no longer be regulated so as to be adapted to the mail volume and an overload of the system can occur.

However, such a method is not suitable for use in bulk processing of mailpieces as is carried out, for example, in mail centers.

GENERAL DESCRIPTION OF THE INVENTION

The invention provides a method for separating letters in which even large, irregularly spaced and disordered piles of letters that are being transported on the conveyor belt are rendered reliably and in trouble-free serial operation into a continuous stream of letters that are largely not lying on top of each other and that are distributed virtually homogeneously over the conveyor belt.

According to the invention, at least one retention plate affixed at an axis of rotation in a radial orientation with respect thereto rotates around the axis of rotation that is arranged crosswise to the conveying direction of a conveyor belt, horizontally and above the conveyor belt, in such a way that the retention plate situated below the axis of rotation has a speed component in a direction that is opposite to the conveying direction of the conveyor belt.

The method is especially well-suited for separating standard letters that are being transported and that are piled randomly on top of one another, having formats comparable to the formats DIN B6 or DIN C6, DIN long, DIN C5 or else larger formats, for example, when large envelopes are used.

Such letters are typically delivered unsorted in boxes or sacks to a transshipment station of a postal service provider where they are separated and sorted in preparation for their further forwarding.

The invention likewise provides a device that is suitable for carrying out the method having an axis of rotation that is arranged crosswise to the conveying direction of a conveyor belt, horizontally and above the conveyor belt, and one or more retention plates that are affixed at the axis of rotation in a radial orientation with respect thereto and that rotate around said axis of rotation, whereby the rotating retention plates can be driven in such a way that, in at least one operating state of the device, they have a speed component that is opposite to the conveying direction of the conveyor belt whenever they are below the axis of rotation.

The axis of rotation and the retention plate are arranged in such a way that the letters fed onto the conveyor belt of the device accumulate in front of the retention plate whenever the axis of rotation is in a position in which the retention plate faces perpendicularly downwardly, forming a right angle with the conveyor belt. This position of the axis of rotation and of the retention plate is to be designated here as the initial position so that reference can be made to this position hereinafter.

As a result of the rotational movement having the direction of rotation shown, the letters lying directly in front of the retention plate in the initial position are pushed back during the first half-period of the rotation or thrown upwards or set upright if the retention plate reaches under the letters.

Due to the carrying movement of the rotating retention plate and promoted by the accumulation pressure being built up in front of the device, the letters that have been thrown upwards or set upright manage to enter the downstream conveying area of the conveyor belt, beyond the axis of rotation.

Moreover, the result of the rotational movement is that, during the course of a period of the movement, a gap between the retention plate and the conveyor belt opens up and closes again, through which a few of the letters accumulated at the bottom in the initial position are conveyed into the downstream conveying area of the conveyor belt.

Thus, on the downstream conveying side of the device, a random arrangement of letters forms on the conveyor belt in which the letters are virtually homogeneously distributed on the conveyor belt and are largely not lying on top of each other.

The efficiency of the method of the invention can be increased in that two or more retention plates are installed at the axis of rotation in a radial orientation with respect thereto, whereby an especially preferred embodiment of the invention is characterized in that the angular distances between the retention plates are the same.

In this manner, it is possible to decrease the extension of the plates in the radial direction with respect to the axis of rotation as compared to the case with only one plate and nevertheless to achieve the same accumulation effect as in this case since this effect arises solely from the surface of the plates that are positioned perpendicularly on the conveyor belt. The extension of the gap that forms between the conveyor belt and the plates during the rotation, however, depends on the radial extension of the plates and, in the embodiment with several plates, it is smaller than in comparison to the embodiment with one plate.

The frequency of the periodic course resulting from the use of the method of the invention is increased in the embodiment with several plates at a rotational frequency that is the same as in the embodiment with only one plate, so that even a very high mail volume can be processed.

It is likewise especially advantageous for one or more of the retention plates to have a smaller radial extension than at least one other plate, as a result of which a gap remains between the conveyor belt and a retention plate having a smaller radial extension when this plate is positioned perpendicularly downwardly on the conveyor belt, through which gap the letters can pass that are in the lower layer of the pile that has accumulated in front of the device.

In this manner, the risk of overloading the device in case of a very high mail volume is reduced.

Moreover, with an eye towards reducing this risk, it is very advantageous to affix the axis of rotation onto the device in such a way that the height at which it is arranged above the conveyor belt can be varied.

In another preferred embodiment of the invention, the end piece of at least one of the retention plates is configured elastically in alignment with the radius in order to avoid damage to the letters that have been pushed back and in order to promote the upwards throwing movement and the carrying of the letters by means of a whip-like effect.

Another improvement in the efficiency of the method for separating letters according to the invention can be achieved in that the separation by means of rotating retention plates on the basis of the above-described method according to the invention is preceded by a first separation of letters that is carried out using a retention device.

In a preferred embodiment, this first preceding separator has a hanging retention plate attached at an axis arranged above the conveyor belt crosswise to the conveying direction whose attachments allow it to swing back and forth and whose end piece is preferably configured so as to be elastic.

Here, the first separation device is configured in such a way that a pile of letters can pass it, whereby the letters present in the pile are then separated.

BRIEF DESCRIPTION OF THE DRAWINGS

Especially preferred embodiments of the invention will be explained below on the basis of the accompanying drawings. Schematic views show the following.

DETAILED DESCRIPTION

Figure 1:
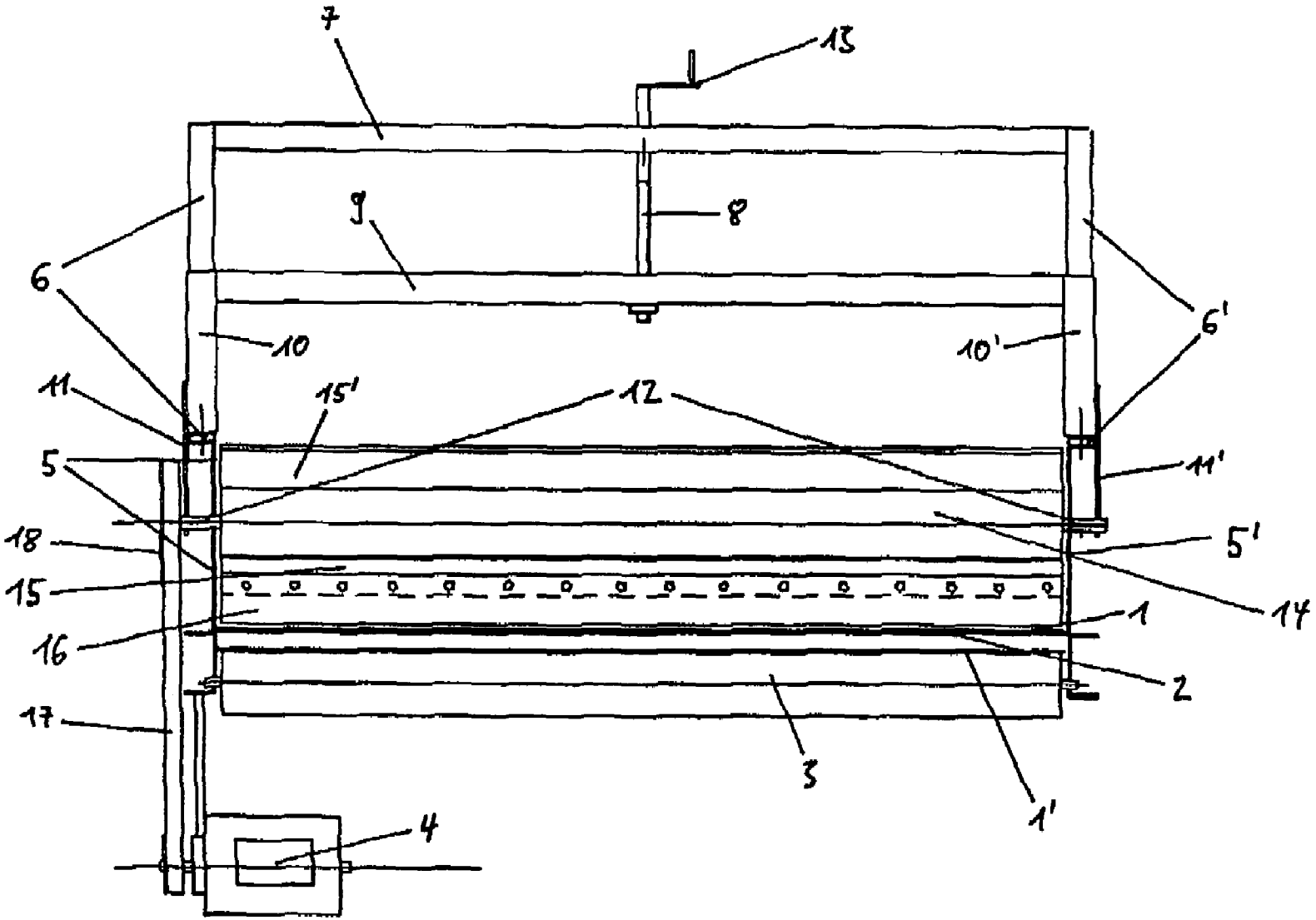
FIG. 1 shows a cross section through a device for separating letters having two retention plates as seen in the conveying direction.

Letters are fed in irregularly spaced, disordered piles to a conveyor belt 1 or 1' of the device. The part of the conveyor belt 1 moving in the conveying direction lies on a contact surface 2, is deflected at the end of the conveying section and runs back underneath the contact surface 2.

The returning part 1' of the conveyor belt makes friction contact with a rotating roller 3 that, driven by a motor 4 that is not more precisely specified here, drives the conveyor belt.

The device for separating letters that is affixed to the conveyor has a holding frame that spans the conveyor and that is attached to lateral delineations 5 and 5' of the conveyor belt. The frame includes a frame construction that is joined to the lateral delineations 5 and 5' so as to be fixed relative to the device and that has lateral tubes 6 and 6' positioned upwardly perpendicular to the conveyor belt as well as a cross brace 7 by means of which a centered thread is driven downwardly in the direction of the conveyor belt 1.

A screw 8 is inserted into the thread and the screw 8 is centrally attached rotatably at its end facing the conveyor belt 1 to a cross brace 9 of another movable part of the frame that is held in position by the screw 8.

The movable part of the frame likewise has lateral tubes 10 and 10' which are joined to the cross brace 9 at their upper ends facing away from the conveyor belt 1 and which surround the lateral tubes 6 and 6' of the part of the frame that is rigidly joined to the conveyor so that the lateral tubes 6 and 6' serve as a guide for the lateral tubes 10 and 10' of the movable part of the frame.

Receptacles 11 and 11' are attached at the lower ends of the lateral tubes 10 and 10' facing the conveyor belt 1, an axis of rotation 12 being rotatably supported on and attached at the receptacles 11 and 11' in such a way so as to span the conveyor belt parallel to the above-mentioned cross braces 7 and 9.

The distance between the axis of rotation 12 and the conveyor belt 1 can be varied by turning the screw 8, which can be done using a crank 13 attached to the end of the screw 8 that lies above the cross brace 7.

Inside the lateral delineations 5 and 5', the axis of rotation 12 is surrounded by a roller 14 to which retention plates 15 and 15' are firmly attached in such a way that they are arranged relative to the axis of rotation 12 in the radial direction and at equal angular distances with respect to each other.

Figure 2:
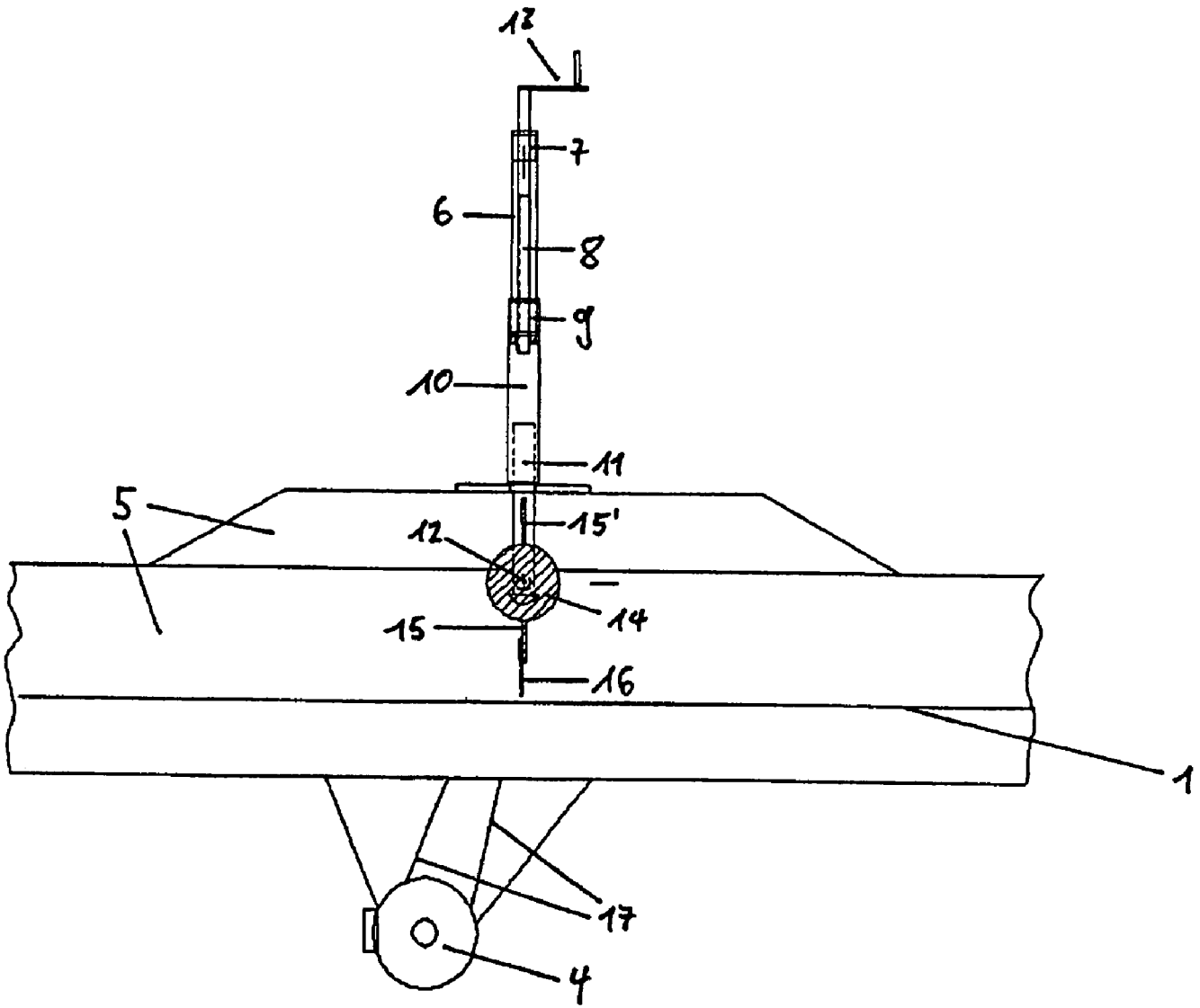
FIG. 2 shows a longitudinal section through this device as seen perpendicular to the conveying direction.
Figure 3:
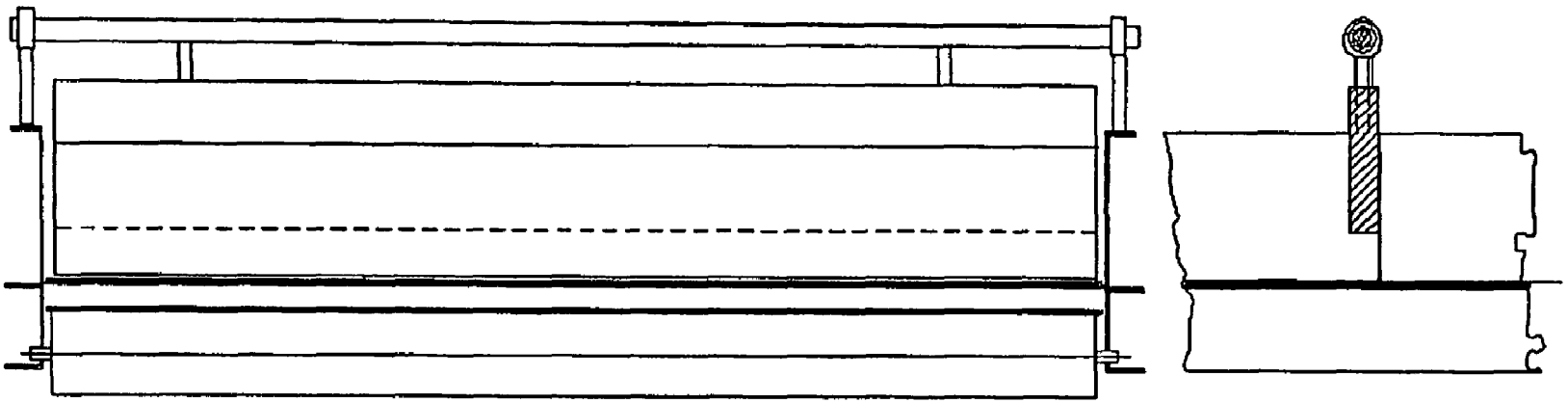
FIG. 3 shows a cross section and a longitudinal section through the first separation device, which can precede the device shown in the other figures.

An end piece 16 made of an elastic material is attached to one of the retention plates 15 and, in the position of the axis of rotation 12 and of the retention plates 15 and 15' shown in FIGS. 1 and 2, the end piece 16 should extend to near the conveyor belt 1 in order to be able to effectively carry out the method for separating letters according to the invention.

Another retention plate 15' does not have an elastic end piece and thus has a smaller radial extension than the retention plate 15 that is provided with the end piece 16.

The rotational movement of the axis of rotation 12 and of the retention plates 15 and 15' is likewise driven by the motor 4 via a V-belt 17 that encircles the upper radius of a drive wheel 18 attached to an extension of the axis of rotation 12 projecting beyond the receptacle 11 on the motor side in such a way as to cause the rotational movement by virtue of the friction contact.

The employed V-belt 17, like the other described elements, can of course be replaced by other elements having the same effect. For example, it is possible to use a motor situated in the rotating roller rather than the V-belt or else a motor that is directly mounted from the outside—especially as a direct drive. The adjustability can be likewise achieved in this manner.

The described height adjustment can also be achieved, for example, in that the receptacle of the separator is configured in the side walls of the conveyor belt so as to be height-adjustable. A height adjustment in several—especially two or three—stages is just a suitable as a continuous adjustment.

The invention claimed is:

1. A method for separating letters in which irregularly spaced and disordered piles of letters that are being transported on a conveyor belt are rendered into a continuous stream of letters that are largely not lying on top of each other and that are distributed virtually homogeneously over the conveyor belt, the method comprising rotating at least one retention plate affixed at an axis of rotation in a radial orientation with respect thereto around the axis of rotation that is arranged crosswise to a conveying direction of the conveyor belt, horizontally and above the conveyor belt in such a way that a retention plate situated below the axis of rotation has a speed component in a direction opposed to the conveying direction of the conveyor belt.

2. The method according to claim 1, comprising rotating several retention plates around the axis of rotation.

3. The method according to claim 1, comprising varying the distance between the axis of rotation and the conveyor belt.

4. A device for separating letters that renders irregularly spaced and disordered piles of letters that are being transported on a conveyor belt into a continuous stream of letters that are largely not lying on top of each other and that are distributed virtually homogeneously over the conveyor belt, the device comprising an axis of rotation that is arranged crosswise to a conveying direction of a conveyor belt, horizontally and above the conveyor belt, and one or more retention plates affixed at the axis of rotation in a radial orientation with respect thereto and rotatable around said axis of rotation, wherein the rotating retention plates can be driven in such a way that, in at least one operating state of the device, they have a speed component that is opposite to the conveying direction of the conveyor belt whenever they are below the axis of rotation.

5. The device according to claim 4, wherein angular distances between the retention plates are the same.

6. A device for separating letters that renders irregularly spaced and disordered piles of letters that are being transported on a conveyor belt into a continuous stream of letters that are largely not lying on top of each other and that are distributed virtually homogeneously over the conveyor belt, the device comprising an axis of rotation that is arranged crosswise to a conveying direction of a conveyor belt, horizontally and above the conveyor belt, and one or more retention plates affixed at the axis of rotation in a radial orientation with respect thereto and rotatable around said axis of rotation, wherein the rotating retention plates can be driven in such a way that, in at least one operating state of the device, they have a speed component that is opposite to the conveying direction of the conveyor belt whenever they are below the axis of rotation, wherein one or more of the retention plates has a smaller extension in the radial direction relative to the axis of rotation than at least one other retention plate.

7. A device for separating letters that renders irregularly spaced and disordered piles of letters that are being transported on a conveyor belt into a continuous stream of letters that are largely not lying on top of each other and that are distributed virtually homogeneously over the conveyor belt, the device comprising an axis of rotation that is arranged crosswise to a conveying direction of a conveyor belt, horizontally and above the conveyor belt, and one or more retention plates affixed at the axis of rotation in a radial orientation with respect thereto and rotatable around said axis of rotation, wherein the rotating retention plates can be driven in such a way that, in at least one operating state of the device, they have a speed component that is opposite to the conveying direction of the conveyor belt whenever they are below the axis of rotation, wherein an end piece of at least one of the retention plates is configured elastically in alignment with the radius relative to the rotational movement of the retention plates.

* * * * *